US005544864A

United States Patent [19]

Gabriel-Lacki et al.

[11] Patent Number: 5,544,864

[45] Date of Patent: Aug. 13, 1996

[54] COLLAPSIBLE PORTABLE CHILD'S PLAY-PEN

[75] Inventors: Christopher Gabriel-Lacki, Pointe-Claire; Andrzej Krysztofowicz, Brossard, both of Canada

[73] Assignee: Quinn Wise & Associates Inc., Toronto

[21] Appl. No.: 273,066

[22] Filed: Jul. 11, 1994

[51] Int. Cl.[6] ..... E04H 17/16; A47D 7/01; F16D 3/00

[52] U.S. Cl. ..... 256/25; 256/26; 5/99.1; 5/114; 403/102

[58] Field of Search ..... 256/24, 25, 26, 256/27, 45, 60, 66; 5/93.1, 99.1, 94, 98; 403/349, 325, 102

[56] References Cited

U.S. PATENT DOCUMENTS

| | | | |
|---|---|---|---|
| 2,698,443 | 9/1951 | Ralick | 5/99 |
| 3,026,161 | 3/1962 | Mickelson | 403/325 X |
| 3,339,213 | 9/1964 | Spencer | 256/25 X |
| 3,699,594 | 10/1972 | Matthey-Doret | 5/99 |
| 4,044,411 | 8/1977 | Peterson | 5/99 |
| 4,376,318 | 3/1983 | Cirillo | 5/99 |
| 5,279,006 | 1/1994 | Teng | 5/99.1 |

OTHER PUBLICATIONS

Excerpts from Graco 1991 Catalogue.
Excerpts from Evenflo "1990's" Catalogue.
Excerpts from Century 1990 Catalogue.
Excerpts from Century 1992 Catalogue.
Excerpts from Century 1993 Catalogue.

*Primary Examiner*—Blair Johnson
*Assistant Examiner*—Bruce A. Lev
*Attorney, Agent, or Firm*—Arne I. Fors; Jeffrey T. Imai; D. Doak Horne

[57] ABSTRACT

A collapsible, portable child's play-pen, which may be foldably collapsed onto two half-members which are pivotably coupled together along an axis and which together form a base for the play-pen, which may then be subsequently folded together to form a compact portable unit. First and second frame members, each pivotably coupled to the base along parallel but mutually opposite edges of the base, form one set of opposite side walls of the play-pen. Each of the first and second frame members are provided with a respective pair of first and second pivotable linking arms. One end of each of the first pair of linking arms is pivotably coupled to a first frame member, and similarly one end of each linking arm of the second pair of linking arms is pivotably coupled to the second frame member. Each of the pairs of linking arms further possesses a releasible lock to allow releasible locking engagement of the other ends of the first pair of linking arms with the other ends of the second pair of linking arms so that when such linking arms are releasibly connected to each other they form generally parallel but opposite remaining sides of the play-pen when the play-pen is in the open position. The linking arms and frame members are adapted to support a flexible sheet in a vertical position generally around a periphery of the play-pen when the play-pen is in the open position to thereby form a plurality of vertical walls. A zipper is located on the flexible sheet along at least a portion of the upper side edges of the child's play-pen which when unzipped allows at least two of the linking arms to be pivoted free from the flexible sheet, and the unit folded in a collapsed position.

20 Claims, 7 Drawing Sheets

FIG. 1.
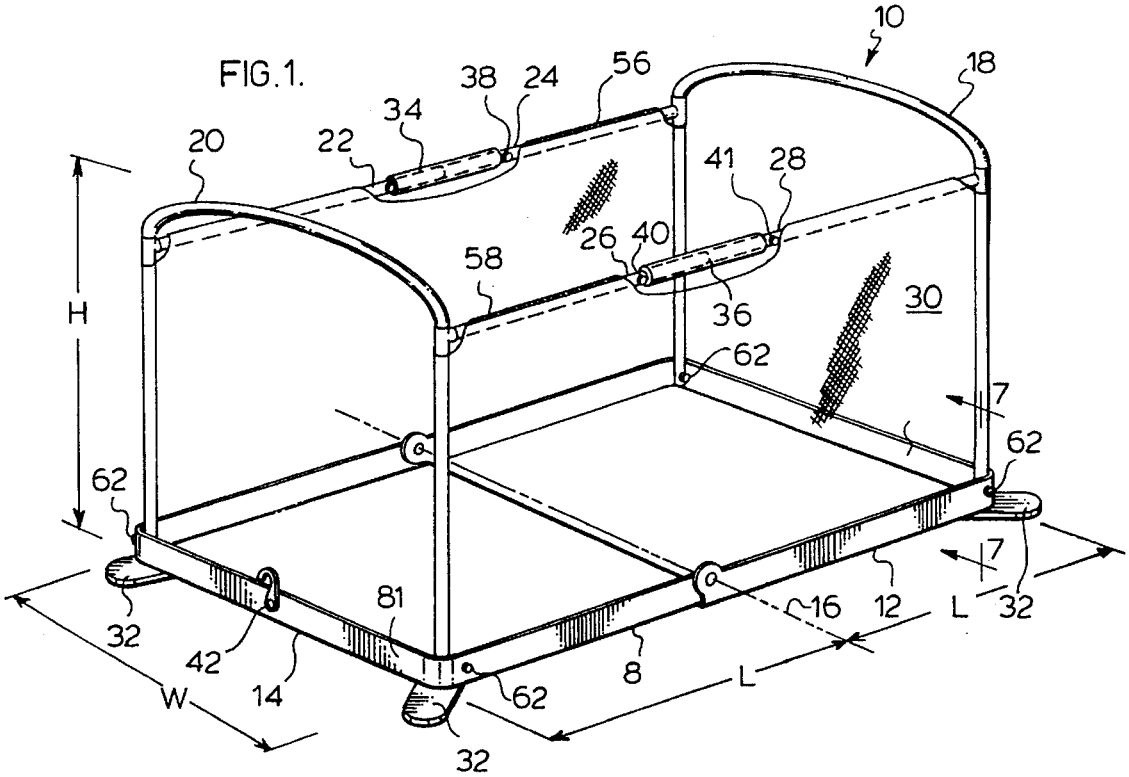
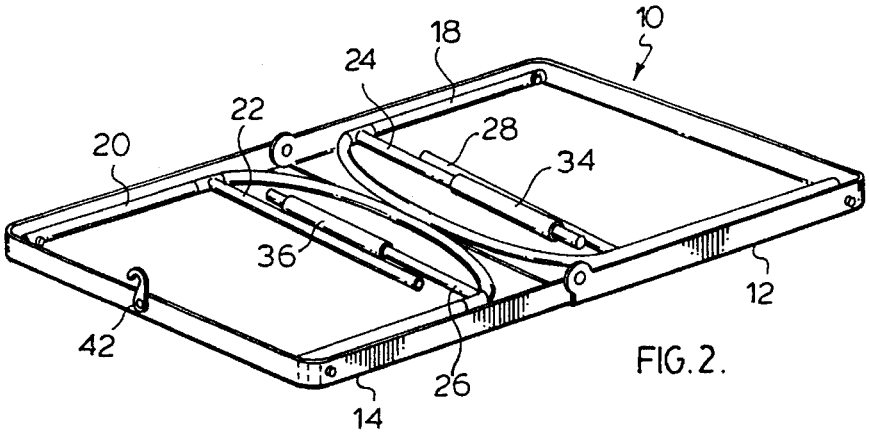
FIG. 2.

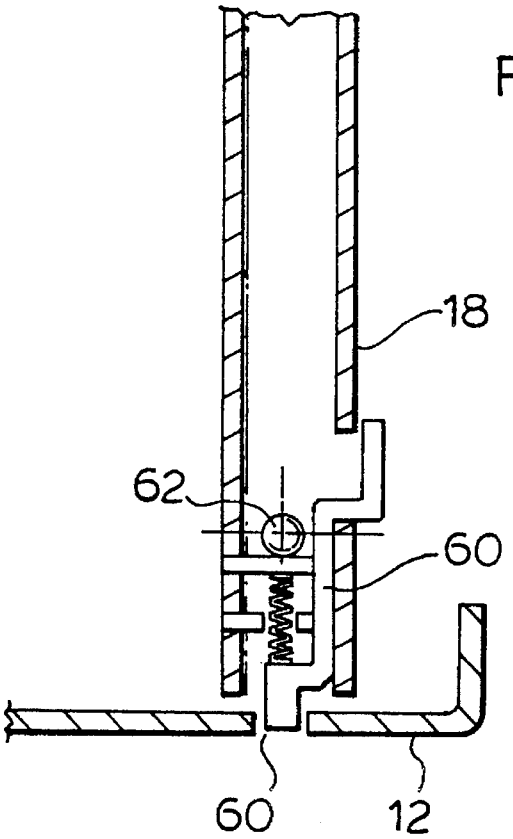
FIG. 7.
FIG. 8.
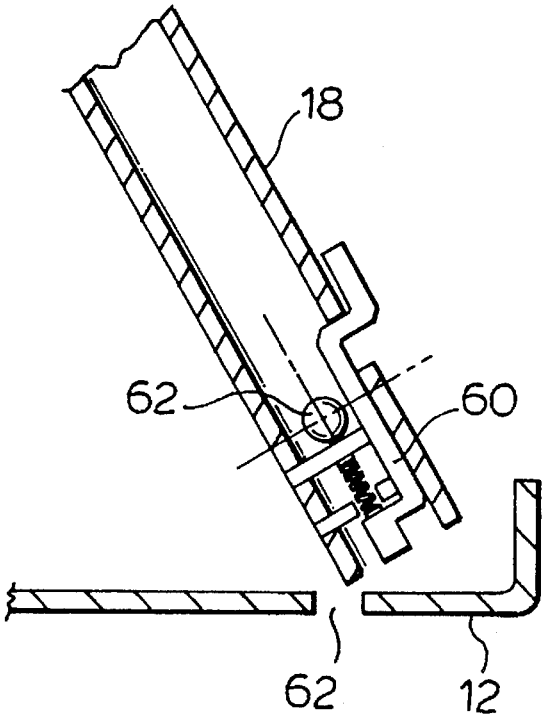

COLLAPSIBLE PORTABLE CHILD'S PLAY-PEN

FIELD OF INVENTION

The present invention relates to a portable child's play-pen, and more particularly to a collapsible play-pen whose vertical walls may be collapsed into the flat base of such play-pen, wherein the base may then be folded together thereby forming a compact portable carrying ease.

BACKGROUND OF THE INVENTION

A plethora of prior art devices exist for portable collapsible child's play-pens. A few of such devices are described and illustrated in the following patents, namely U.S. Pat. Nos. 3,699,594, 4,819,285, 4,044,411, 4,692,953, 5,197,154, 3,722,009, 4,811,437, 4,097,942, 5,228,154, 5,243,718 and 5,279,006, as well as the applicant's co-pending U.S. application Ser. No. 08/384,887 filed Feb. 3, 1995.

As may be seen from the above patents, a number of these devices make use of foldable half members, which when the walls of the play-pen are collapsed onto the half-members, and they are then folded together, may be used as a portable carrying case for the play-pen.

Some of these, specifically for example U.S. Pat. No. 3,699,594, teach an ingenious design, having foldable end members 18 and 19, and side frame members 24, 25 and 26, 27, which may be folded onto end members 18, 19, and the end members may then be collapsed onto half-shells 1 and 2. It has not been immediately apparent, however, how to improve the design of U.S. Pat. No. 3,699,594 to eliminate metal or wood structural elements in the side walls which retain and support the side walls to thereby eliminate the weight problem such members cause, yet still maintain a sturdy, lightweight, and most importantly an easily collapsible and portable structure.

A number of attempts at using lightweight fabric as wall material to thereby reduce the weight of the play-pen have been put forward, such as U.S. Pat. No. 4,044,411, 4,692,953, and 4,819,285. The first two of these patents also incorporate a zipper. While these patents are ingenious in their manner of collapse and folding, they generally have other drawbacks unique to that particular design, which reduces the practicality or usefulness of the design. For example, U.S. Pat. No. 4,819,285, which incorporates a flexible fabric netting for the side walls, and also hinges 134, 132 proximate the mid-section of bottom rail tubes 130, 135 and 128, 133 respectively, necessarily requires top rail tubes 124 and 126 which are secured by snap fittings 210 to bottom rail tubes 128, 130, 133 and 135 (see FIGS. 1, 2, and 4). These necessary additional top rail tubes 124, 128 add further weight, reducing the portability of the crib.

Likewise, U.S. Pat. No. 4,692,943 teaches a portable collapsible crib which includes a rigid first top rail tube 28 and a rigid second top rail tube 30, each separately hinged at midpoint 29 and 31 respectively by a first hinge 32 and second hinge 34 (see FIG. 4 and Col. 3, line 40–45). Notably, however, to set up the crib, the design requires that the entire crib must be lifted so as to be able to pivot legs 48 and 50, and then legs 52 and 54, so as to place them under the base of the unit 88 to thereby suspend the crib from the newly erected legs. This requires considerable dexterity and some strength to simultaneously lift the crib and at the same time position the feet under the lifted crib.

In the same manner, U.S. Pat. No. 4,044,411 possesses drawbacks, in particular relating to the length of time required to completely erect the crib. In this respect, U-shaped crib rods 8 and 9 (see FIGS. 6 and 7) are first required to be pivotably raised. Thereafter ropes 34 and 35 need then to be joined as shown in FIGS. 6 and 7. Subsequently, crib rods 8 and 9, which are telescoping rods, then need to be extended, requiring a spring biased button 37 to be depressed at each end of each of telescoping rods 8, 9 so as to extend the rods 8, 9 to thereby pull the ropes 34, 35 tight. Zippers 30 and 31 then need to be zipped shut to form the completely erected crib (Col. 3, lines 59–69, Col. 4, lines 1–15). This procedure, which is reversed on collapse of the unit, is time consuming, and accordingly reduces the speed at which the unit may be both erected or collapsed, thus decreasing the portability of the crib.

SUMMARY OF THE INVENTION

Accordingly, in order to overcome the above disadvantages of prior art devices, the present invention provides for a unique child's play-pen which may be rapidly foldably collapsed into a compact yet lightweight carrying case for easy transportation, and which may be rapidly and easily foldably withdrawn from such case when desired to be used, without use of tools or awkward disassembly or reassembly procedures.

In a broad aspect, the collapsible, portable child's play-pen of the present invention comprises a pair of half members hingeably coupled to each other along an axis, each pivotable about the axis from a first open position wherein each lies in a substantially flat plane to form a base, to a second portable closed position wherein each are folded together in substantially mutually overlying relationship. A pair of frame members are each pivotably coupled at their respective ends to the base proximate parallel but opposite side edges of the base, wherein such frame members may be pivoted onto the base during collapsible folding of the play-pen. A first pair of linking arms are provided, pivotably coupled to one of the frame members at one end thereof and at another end extending generally perpendicularly outwardly to such frame member when the play pen is in the open position. A second pair of linking arms are also provided, likewise pivotably coupled to the other frame member at one end thereof and at the other end extend generally perpendicularly outwardly from the frame member when the play-pen is in the open position.

In the above broad aspect of the invention, at least one linking arm of each pair of first and second linking possesses releasible locking engagement means to allow releasible locking engagement of a respective linking arm of the first pair of linking arms with a respective linking arm of the second pair of linking arms, so as to form two generally parallel but opposite upper side edges of the child's play-pen when it is in the open position. The linking arms and frame members are each adapted to support on the upper side edges thereof a flexible sheet, usually in the form of a synthetic fabric netting, in a vertical position around a periphery of the play-pen when the play-pen is in the open position, thereby forming a plurality of vertical walls of the play-pen. Importantly, releasible securement means, usually in the form of either a zipper, a plurality of releasible snap fasteners, or strips of VELCRO™[1], are provided along a portion of said upper side edges of the child's play-pen. At least two linking arms each on mutually opposite upper side edges of the play-pen may, when released from locking engagement with a corresponding locking arm and when further released by the releasible securement means from the flexible sheet, be pivoted free from the flexible sheet and folded onto a respective frame member to which it is pivotably coupled. Both the frame members and the other two linking arms together with the flexible sheet may then at the same time be pivotably folded onto the base, and the half-members pivoted about the first axis to close the play-pen and render it in a portable configuration. ≠[1] Trademark of Velcro Industries B.V. for complemental strips of fabric having thereon complemental parts in the form releasible hook and loop fasteners which adhere to each other when pressed together.

Notably, as would be immediately apparent to any person skilled in the art, for the play-pen described above to be collapsed in the manner disclosed, it is necessary that the dimensions of the play-pen be in certain proportion to one another in order to permit folding of the frame members and linking arm members onto the half-members without interference, and the half-members with such components folded thereon to be folded about its axis to a closed position. More particularly, as may be clearly understood from the accompanying disclosure and detailed description of the drawings which later follow, and it nearly goes without saying, that for all half-members having a width W and a length L, when they are pivotably coupled together and lying in the same plane they form a base of the play-pen of width W and length 2L. The linking arms, by virtue of the configuration for the play-pen recited above, need be substantially of a length of L. Accordingly, for the linking arms to be able to be folded onto their respective frame members of width W, it will be necessary for length L to always be equal to or less than width W, so that the linking arms of length L will not exceed dimension W when folded onto the respective frame members. Also, for frame members of height H, height H must always be equal to or less than length L so that the frame members of height H may be folded onto half-members of length L.

In a preferred embodiment of the invention, the releasible securement means located on the flexible sheet is located along one linking arm of the first pair of linking arms, as well as along a mutually parallel and diagonally opposite linking arm when the play-pen is in the open position. Alternatively, the releasible securement means may be located along each linking arm of the first pair of linking arms, or alternatively along each linking arm of the second pair of linking arms. In either embodiment the linking arms proximate the releasible securement means, when released by the releasible securement means from the flexible sheet, may be pivoted free from the flexible sheet and folded onto a respective frame member. This embodiment has the advantage that the remaining linking arms, to which the flexible sheet is still attached, will at the same time as the frame members are being foldably collapsed onto the base, will themselves be pivotably folded along with the flexible sheet, onto the frame members. This tendency of self-folding (self-collapse) may be enhanced by addition of spring-biasing means to the linking arms to bias the pivotable linking arms onto a folded position on the frame members.

In an alternative but less preferable embodiment, the releasible securement means located on the flexible sheet is located along each linking arm of the pairs of linking arms when the play-pen is in the open position, and each linking arm, when released by the releasible securement means from the flexible sheet, may be pivoted free from the flexible sheet and folded onto a respective frame member.

To support the frame members in a vertical position when the play-pen is in the erected (open) position, frame member support means are provided. In a preferred embodiment of the invention, such frame member support means are simply proximate side edges of the base which the frame members will each abut when in the substantially vertical position, which prevent further pivotable rotation of the frame members past a substantially vertical position.

In another embodiment, the frame member support means comprises releasibly lockable detent means to allow at least one of the frame members to be lockingly secured in a vertical position when the play-pen is in the open position, and to allow pivotable collapse of the frame member(s) onto the base when the play-pen is desired to be folded into the closed position. In this embodiment the releasible detent means comprises a slidable detent proximate an end of at least one of the frame members, which engages an aperture in a respective half-member when the play-pen is in the open position to lock the frame member in the substantially vertical position.

In the preferred embodiment, the releasible locking engagement means referred to above for locking a respective linking arm of the first pair of linking arms with a respective linking arm of the second pair of linking arms to form upper side edges of the child's play-pen consists of a slidable sleeve which slides along a joint portion of the mating pairs of linking arms. Each of the respective linking arms have a male and female mating surface, to prevent the arms from being pulled apart from within the locking sleeve. The locking sleeve secures the two linking arms together, and prevents them from bending or becoming disengaged from male-female mating engagement, thereby preventing unintended collapse of the play-pen from the open position.

The procedure for collapsing a preferred embodiment of the play-pen to an easily portable carrying case, where zippers are utilized as the releasible securement means, and a slidable sleeve is used as the releasibly lockable engagement means, is as follows.

Firstly, a zipper on one of the upper edges of the sides of the play-pen is unzipped to reveal a linking arm, a slidably locking sleeve and a spring-biased button. The spring-biased button is depressed into an aperture, and the locking sleeve is slid along one of the linking arms to free the linking arms on that side of the play-pen from locked engagement. The male and female joint connections of the linking arms are then detached, and one linking arm is then pivoted to be co-planar with the plane of the frame member to which it is pivotable coupled. The zipper on the other side wall is then unzipped to expose another locking sleeve and respective linking arm. In the same manner as noted above, the locking sleeve is slid along one of the linking arms on that side to expose the connection of the linking arms. The male and female joint connections are then detached and the respective linking arm which is freed from the flexible sheet by the opened zipper is then pivoted onto the respective frame member to which is pivotably coupled. The remaining two linking arms with the attached flexible sheet are then pivoted to be co-planar with their respective frame members. The frame members are at the same time pivotably collapsed onto the base. The flexible sheet is tucked into the interior of the play-pen by the linking arms during the collapsing of the frame members onto the base. The half-members may then be folded together about the axis to thereby render the play-pen in a closed and transportable position.

Accordingly, in the above manner, the play-pen has been easily collapsed into a compact portable container for easy transportation. Any difficult disassembly techniques, or use of tools to undo nuts or bolts has been eliminated, and the play-pen has been able to be collapsed using no more than a pair of hands.

In order to reassemble the play-pen, the reverse of the above procedure is employed.

BRIEF DESCRIPTION OF THE DESCRIPTION OF THE DRAWINGS

Further objects and advantages will appear from the following detailed description of the invention, taken together with the accompanying drawings in which:

FIG. 1 is a perspective view of a preferred embodiment of the present invention, showing the child's play-pen of the present invention in the fully-open position ready for use;

FIG. 2 is a perspective view of the embodiment shown in FIG. 1, shown in the partially collapsed position;

FIG. 7 is a cross-sectional view taken on plane 7–7 of FIGS. 1, 9 and 10 showing optional releasible detent means that may be employed on each of the frame members to lockingly engage the frame members with the base of the play-pen so as to maintain the frame members in a vertical position, showing the releasible detent means in the locked position;

FIG. 8 is a similar view to that shown in FIG. 7, now showing the release detent means in the unlocked position to allow collapse of the frame member onto the base of the play-pen;

Figure 9:
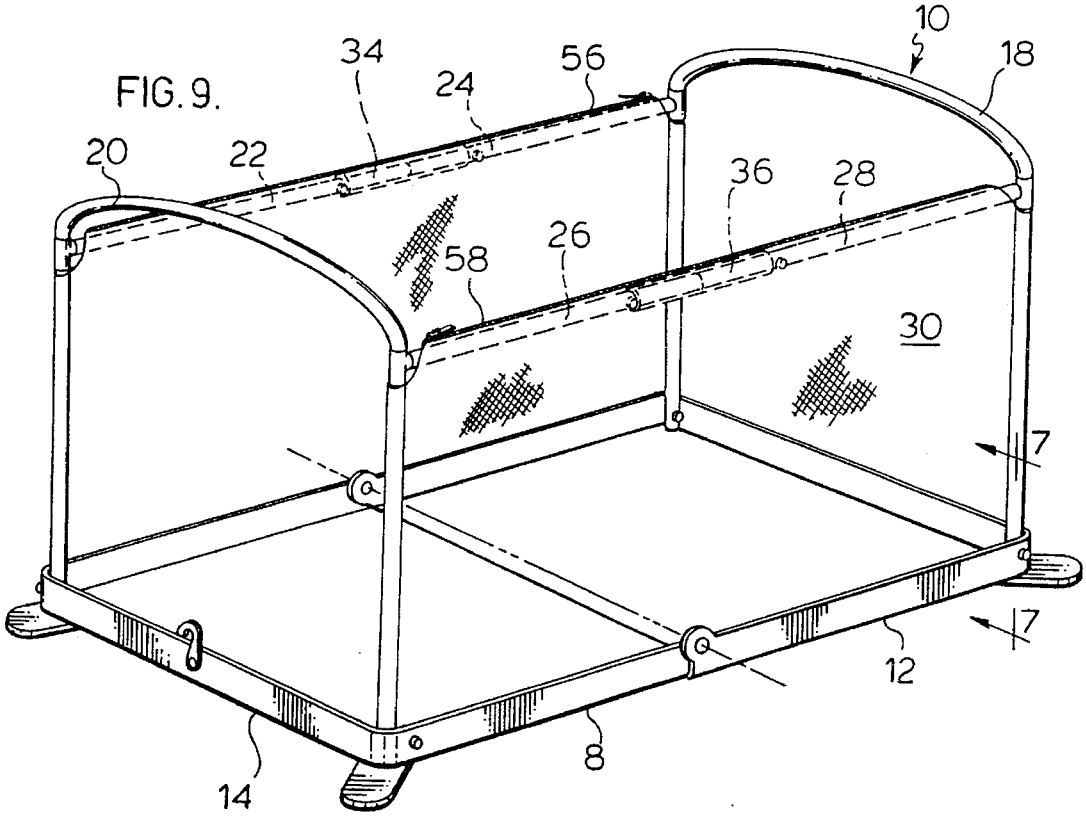
Figure 10:
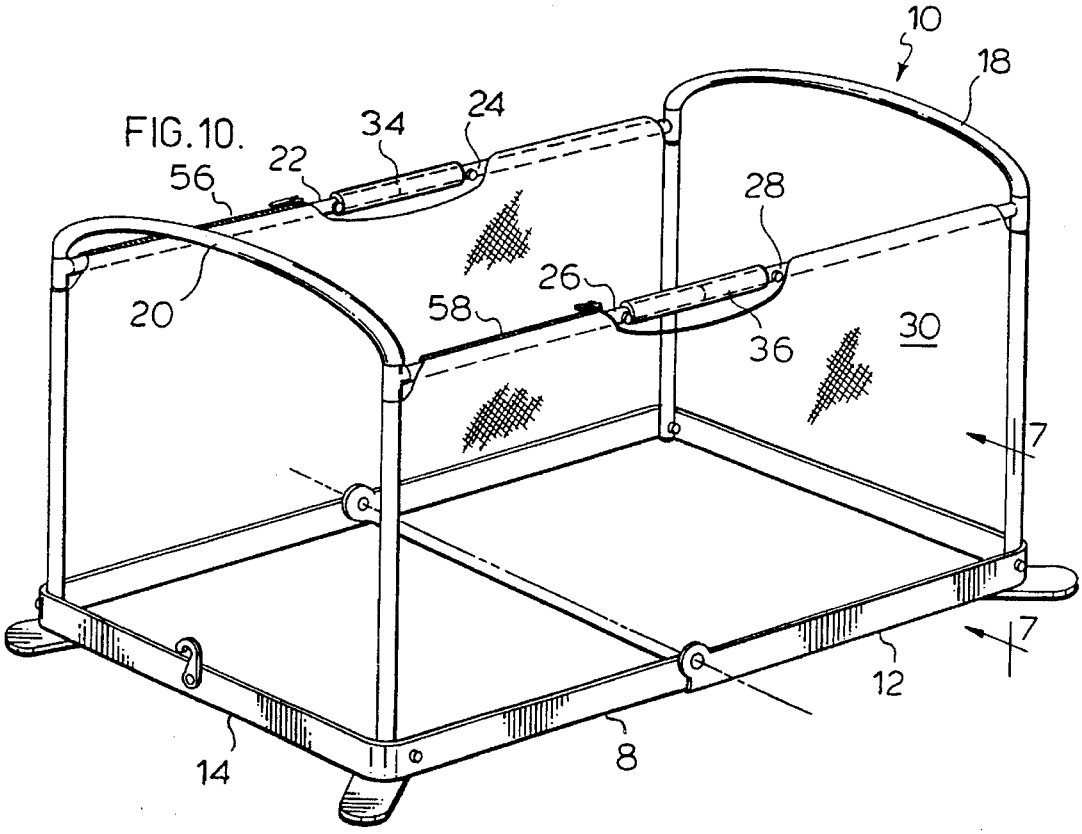

FIG. 9 is a perspective view of another embodiment of the invention, wherein the releasible securement means (shown as a zipper) extends along the flexible sheet on each of two mutually opposite upper side edges of the play-pen over substantially the entire length of said upper side edges; and FIG. 10 is a perspective view of a still further embodiment of the invention, wherein the releasible securement means (zipper) extends along each linking arm of a pair of linking arms pivotably coupled to one of the frame members.

DETAILED DESCRIPTION OF THE INVENTION

Figure 3:
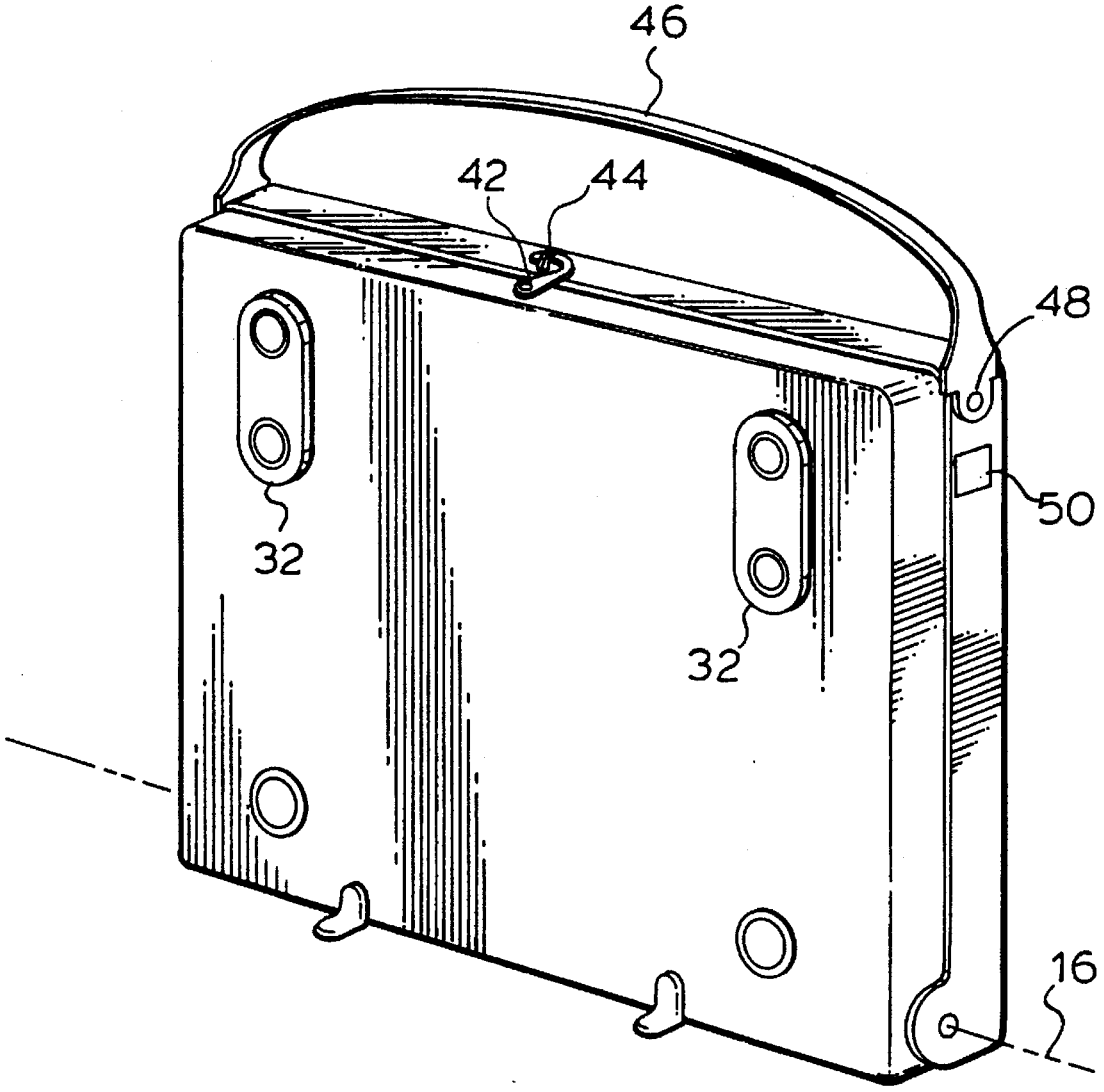
FIG. 3 is a perspective view of the embodiment shown in FIGS. 1 and 2, shown in the fully-closed position.

FIGS. 1, 2, and 3 of the drawings show a preferred embodiment of the collapsible, portable child's play-pen 10 of the present invention in the fully open, partially collapsed, and fully collapsed position, respectively.

As shown in FIG. 1, the base 8 of the play-pen 10 is comprised of two rectangular half-members 12, 14, which are hingeably coupled to each other along axis 16. Each are pivotable about said axis 16, from a first fully open position as shown in FIG. 1, to a second portable closed position, as shown in FIG. 3, wherein each are folded together in substantially mutually overlying relationship.

Frame members 18 and 20 are pivotably coupled to the half-members 12 and 14 proximate respective opposite but parallel ends of the base 8 as shown in FIG. 1.

Figure 4:
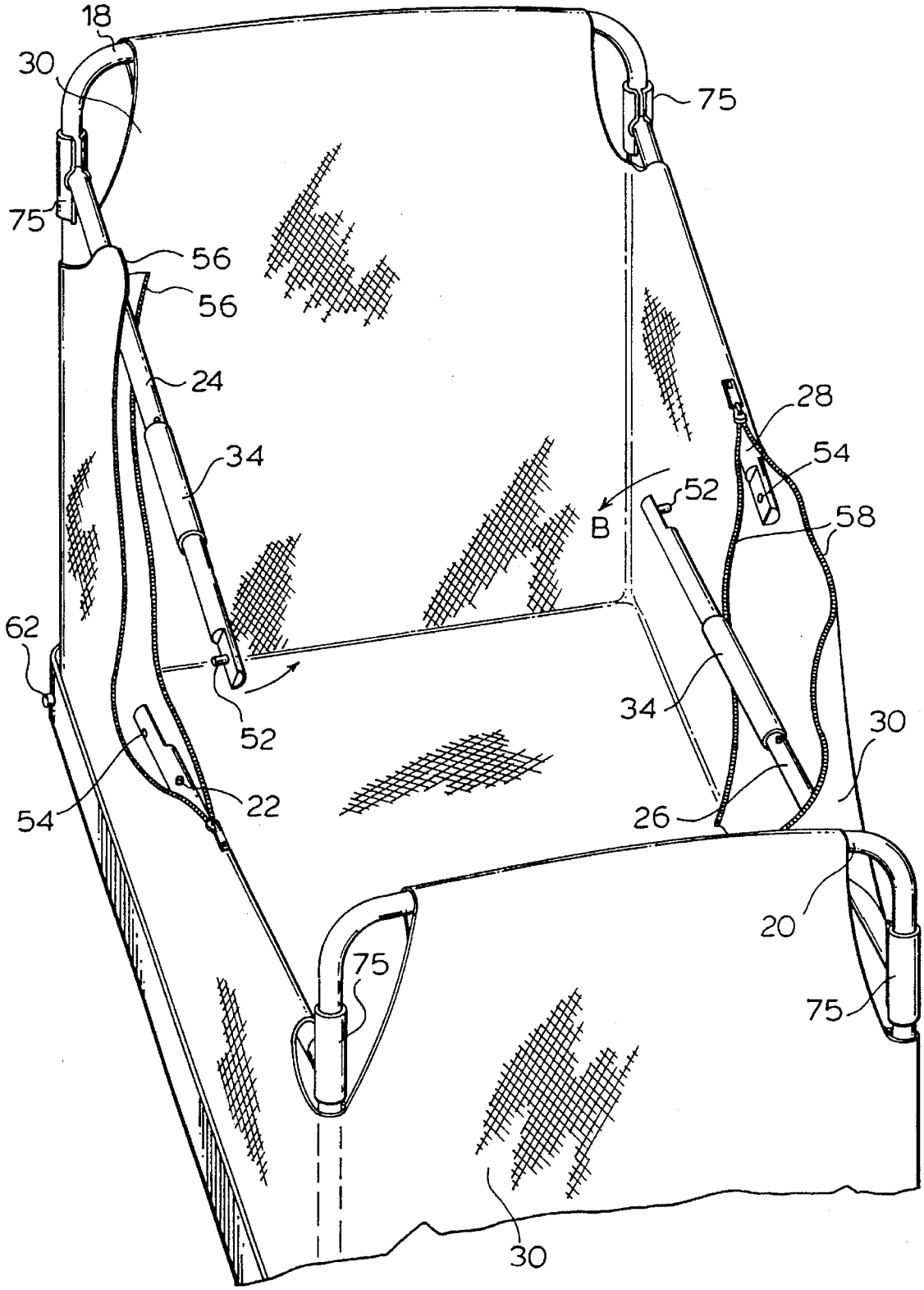
FIG. 4 is top perspective view showing the connection of the linking arms of the play-pen, and the releasible securement (zipper) means along each of said linking arms.

In the preferred embodiment shown in FIGS. 1, 2, and 4, plurality of linking arms 22, 24, 26 and 28 are pivotably coupled to frame member 18 20 by hinge means 75 proximate respective upper side corners of frame members 18 and 20. More particularly, linking arms 22 and 26 are pivotably coupled by hinge means 75 proximate the upper edges of frame member 20, and likewise linking arms 24 and 28 are pivotably coupled to frame member 18. As shown in FIG. 4, linking arms 22, 24, 26 and 28 at the point of pivotable coupling 75 to frame members 18 and 20 may be biased by springs (not shown) for biasing the linking arms and urging the linking arms into an open position as shown in FIG. 1, or a folded position, as shown in FIG. 2. It will be understood that other known biasing mechanisms may be used to urge the linking arms into the open or closed position. Biasing means (not shown) may also likewise be incorporated to bias the frame members into the vertical (open) position, or into the folded (collapsed) position.

Pairs of linking arms 22, 24, and 26, 28 are pivotable onto the plane of each respective frame members 18 and 20, such frame members 18 and 20 being pivotable towards each other to allow each frame member and associated linking arms to be collapsed onto the base 8 as shown in FIG. 2.

The frame members 18 and 20 and linking arms 22, 24, 26 and 28 cooperate to support a flexible sheet 30 in a vertical position around the periphery of the rectangular base 8 when the play-pen 10 is in its open position, thereby forming a plurality of vertical walls, as shown in FIG. 1. The flexible sheet 30 can be comprised of any number of materials, but in the preferred embodiment is of a lightweight nylon mesh or netting. The frame members 18 and 20, in supporting the flexible sheet 30, define the end walls, and the linking arms, in supporting the flexible sheet 30, define the side walls.

Foot members 32 depend outward from base 8 to add further stability to the play-pen 10. The foot members 32 are rotatably mounted to the underside of base 8 and are rotated between an open position as shown in FIG. 1 and a closed position shown in FIG. 3.

Hollow locking sleeves 34 and 36 slide along linking arms 22, 24, 26 and 28 to cover the joinder of linkage arms 22, 24, and 26, 28 respectively near the middle of the sides of play-pen 10. The sleeves 34 and 36 are preferably made of metal such as aluminum but may be made of plastics as well. Sleeve 34 ensures that linking arms 22 and 24 remain connected when the play-pen 10 is in an open position. Similarly, sleeve 36 ensures that linking arms 26 and 28 remain connected when the play-pen 10 is in an open position. Spring biased buttons 38 and 40 and stops 39 and 41 limit the horizontal travel of sleeves 34 and 36 on the linking arms. Spring biased buttons 38 and 40 are depressed within an aperture (not shown) in linking arms 24 and 26 to allow sleeves 34 and 36 to slide along linking arms 24 and 26 when the linking arms are to be joined together. Stops 39 and 41 limit the reciprocal travel of sleeves 34 and 36 on linking arms 22 and 28, but allow the sleeves to cover the joinder of the linking arms.

Referring to FIG. 3, hook 42 joins with hook 44 to attach half members 12 and 14 together in a closed position. Strap 44 allows the folded play-pen 10 to be easily transported. Strap 46 has buckle ends 48 which fit within locking member 50 to attach the strap to the compacted play-pen 10, similar to a seat belt. In the preferred embodiment, there are buckle ends and a locking member on the opposite side of the play-pen 10 to allow strap 46 to be detached from play-pen 10. This allows the strap 46 to be removed to avoid any potential problems with snagging of the collapsed play-pen 10 along transporting runways such as airport baggage conveyor belts.

It is necessary that the flexible sheet 30 be releasibly detachable at certain locations to permit at least two of the linking arms 22, 24, 26 and 28 during collapsible folding of the play-pen 10 to be pivoted so as to be co-planar with their respective frame members 20 and 18. Accordingly, releasible securement means on the flexible sheet 30 are provided, in order to permit the linking arms to be pivoted co-planar with their respective frame member. The releasible securement devices may be snap fasteners or VELCRO™ strips, but in the preferred embodiment shown in FIG. 1, 9 and 10, are zippers 56 and 58. The zippers 56 and 58 may be located along flexible sheet 30 at diagonally opposite side edges of the play-pen 10, as shown in FIGS. 1 and 4. Zippers 56 and 58 in the preferred embodiment shown in FIG. 1 do not fully extend along the entire length of the side walls, but may do so if desired, as shown in FIG. 9. Alternatively, the zippers 56 and 58 may be located along two opposite but parallel portions of the upper side edges of the play-pen 10, as shown in FIG. 10.

FIG. 4 shows linking arms 22 and 24 in an open position. Linking arms 22 and 24 have male and female connections respectively for joining of the two members. Male joint member 52 fits within aperture 54 for joinder of the linking arm 22 and 24 together when the play-pen 10 is in an open position. The identical method is used to join linking arms 26 and 28 together. Respective locking sleeves 34 and 36 may be slid over the resultant joints to prevent unintended disengagement of the linking arms, and allow for later collapse of the play-pen 10 into a folded state when desired.

Figure 5A:
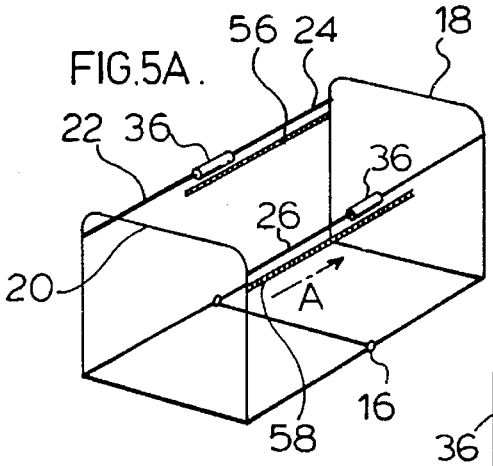
FIG. 5A–5F are sequential schematic diagrams showing the method of collapsing the play-pen of the present invention.
Figure 5B:
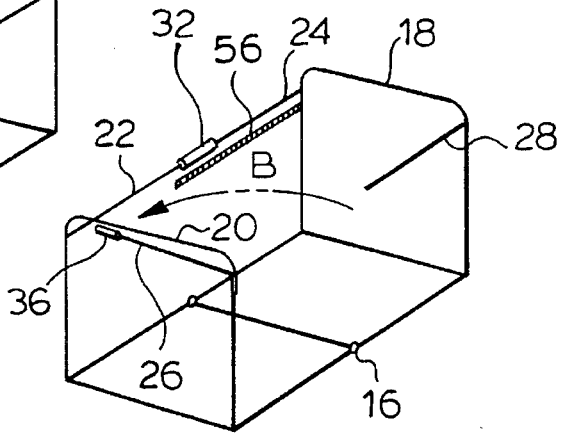
Figure 5C:
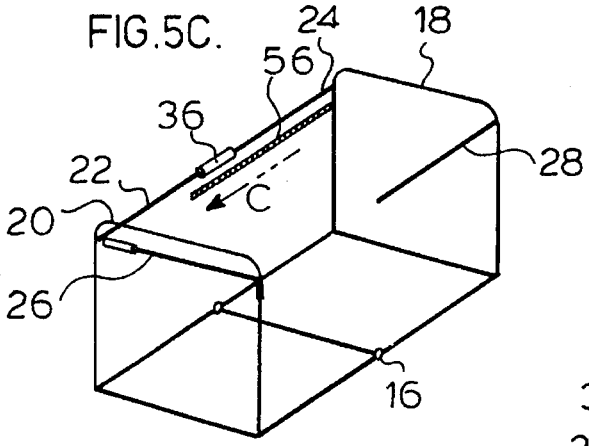
Figure 5D:
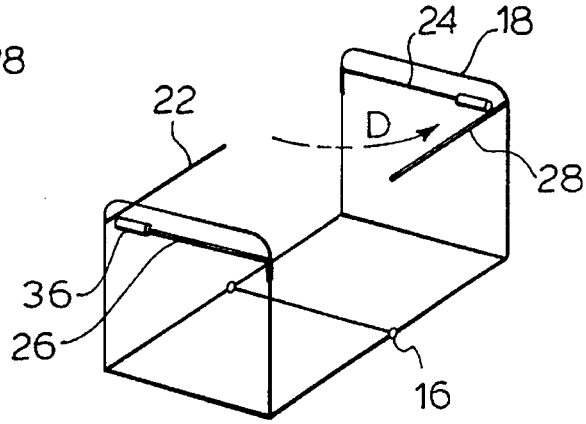

FIGS. 5A–5F show the method of collapsing one embodiment of the play-pen 10 of the present invention. Reference may also be had to FIG. 4. Zipper 58 is unzipped in the direction shown by arrow A towards frame member 18 to reveal linking arm 26, sleeve 36 and spring-biased button 40. Spring-biased button 40 is depressed into an aperture (not shown) and sleeve 36 is slid along linking arms 26 and 28. Male joint member 52 is detached from aperture 54 (FIG. 4). Linking arm 26 is then pivoted in the direction shown by arrow B to be co-planar with the face of frame member 20, as shown in FIG. 5B. The next step is shown by FIG. 5C where zipper 56 is then unzipped in the direction shown by arrow C to expose sleeve 34. In the same manner as noted above, sleeve 34 is slide along linking arms 22 and 24 in the reverse direction of arrow C to expose the connection of linking arms 22 and 24. The male and female joint connections are then detached and linking arm 24 is detached from linking arm 22. Linking arm 24 is then pivoted onto the face of frame member 18 (FIG. 5D) in the direction shown by arrow D. Linking arm 22 with flexible sheet 30 is then pivoted to be co-planar with frame member 20, and linking arm 28 with flexible sheet 30 is pivoted to be co-planar with frame member 18.

Figure 5E:
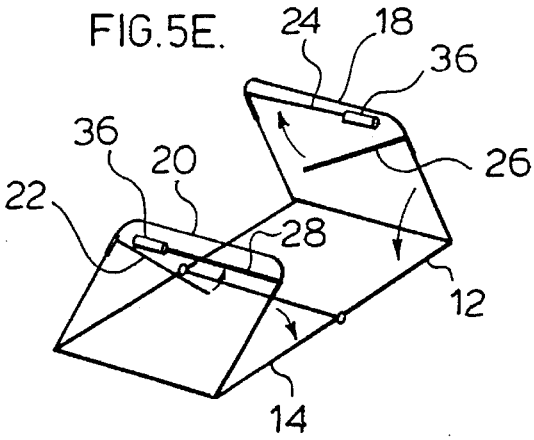
Figure 5F:
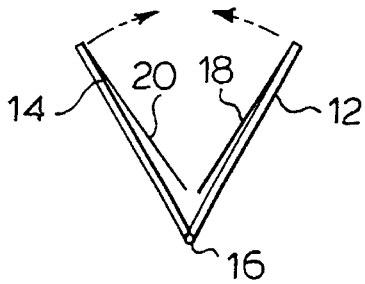

The method of collapsing the play-pen 10 may vary by selecting zipper 58 to be first unzipped, and the order of the pivoting of the linking arms may vary. In the preferred embodiment, the zippers 56 and 58 do not extend along the entire length of the side walls of play-pen 10. Thus, only linking arms 24 and 26 need be removed from the flexible sheet 30 so as to be pivoted co-planar to frame members 18 and 20 respectively, free of the flexible sheet 30. Linking arms 22 and 28 on the other hand, when pivoted co-planar with frame members 20 and 18 respectively, transport some of the flexible sheet 30 into the inside of the collapsing play-pen 10. Advantageously the flexible sheet 30 is thus tucked into the inside of the play-pen 10 during the simultaneous pivotable folding of linking arms 22 and 28 onto frame members 18 and 20, which are at the same time folded onto the respective half-members 12, 14 of the play-pen 10 as shown in FIG. 5E. Half members 12 and 14 are then pivotably folded together by being folded about axis 16 (FIG. 5F).

In order to reassemble the play-pen 10, the reverse of the above procedure is employed.

In another embodiment of the invention, the releasible fastening means in the form of zippers 56 and 58 each extend the full length of the sides of the play-pen 10 as shown in FIG. 9. Accordingly, all of the linking arms, when the zippers release each of the linking arms 22, 24, 26 and 28 from the flexible sheet 30, can then be pivoted co-planar with the respective frame members 18, 20 free of the flexible sheet 30.

FIGS. 6A–6F show the method of collapsing an embodiment of the play-pen 10 with the zippers 56, 58 extending the full length of the sides of the play-pen 10 as shown in FIG. 9. Zipper 58 is unzipped in the direction shown by arrow F towards frame member 18. Spring biased button 40 is depressed into an aperture (not shown) and sleeve 36 is slide along linking arms 26 and 28 in the reverse direction of arrow F to expose the connection of linking arms 26 and 28. Male joint portion 52 of the connection is detached from the female joint portion 54 of the connection (FIG. 4) in respect of each of the two pairs of linking arms 22, 24 and 26, 28, and each of such linking arms may then be pivoted into the plane of the respective frame member 18 and 20, and such frame members 18 and 20 then pivotably folded as before onto respective half-member 12, 14.

Figure 6A:
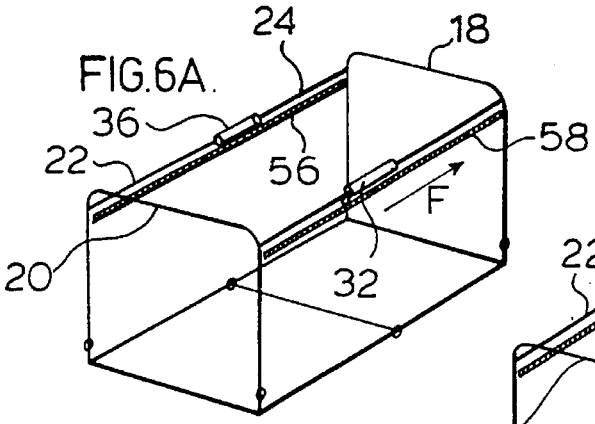
FIG. 6A–6F are sequential schematic diagrams of the method of collapsing another embodiment of the play-pen of the present invention.
Figure 6B:
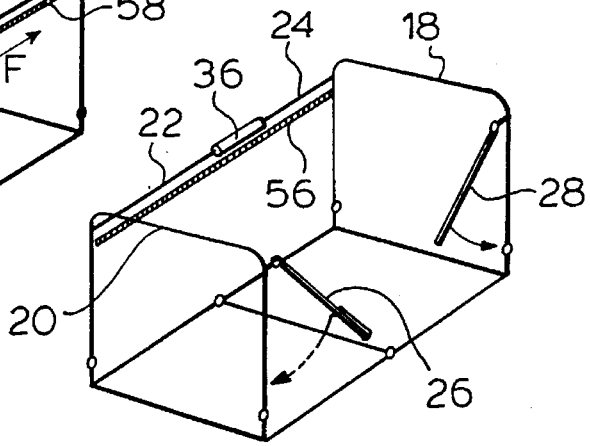
Figure 6C:
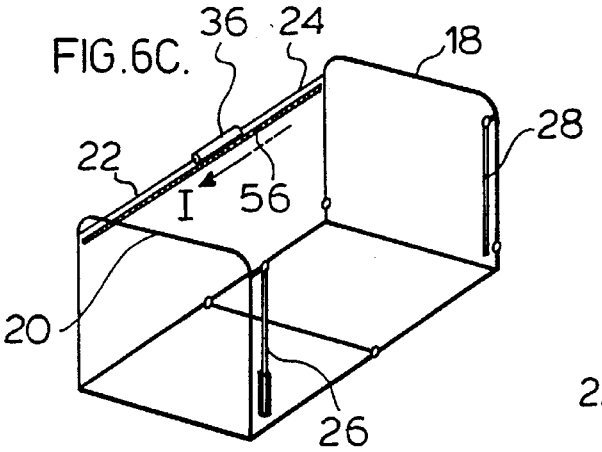
Figure 6D:
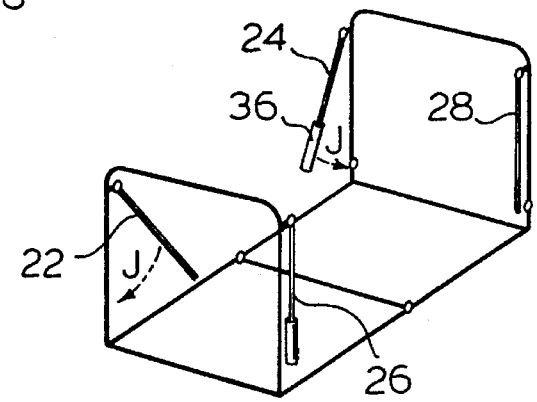
Figure 6E:
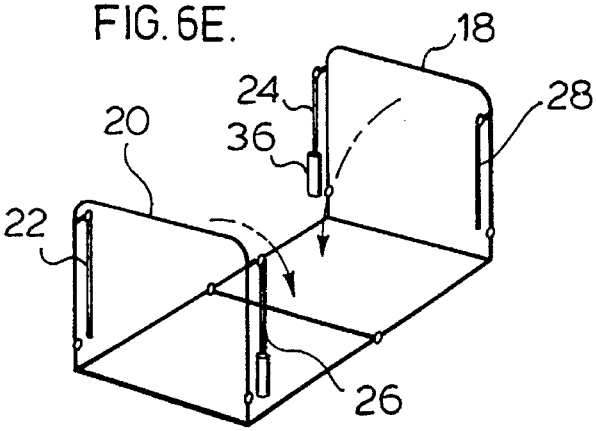
Figure 6F:
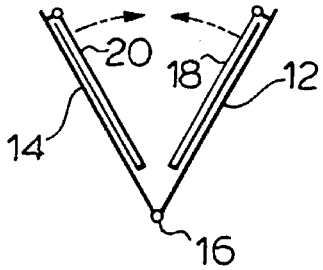

In such embodiment of the invention, the linking arms 22, 24 and 26, 28 may be pivoted onto the frame members 18, 20 by pivoting them each in a horizontal plane similar to the method of collapse shown in FIG. 5B, or by pivoting the linking arms, as shown by the arrows in FIG. 6B. In this latter procedure, linking arm 26 is pivoted downwardly in the direction of the arrow as shown in FIG. 6B. Linking arm 28 is then pivoted downwardly as likewise shown by the arrow in FIG. 6B. Nextly, zipper 56 on the opposite side of the play-pen is then unzipped in the direction shown by arrow I (FIG. 6C). In the same manner as noted above, sleeve 34 is slid along linking arms 22 and 24 in the reverse direction of arrow I to expose the connection of linking arms 22 and 24. The male and female joint connections are then detached and linking arm 24 is detached from linking arm 22. Linking arms 22 and 24 are then pivoted downwardly in the direction shown by arrow J (FIG. 6D). Frame members 18 and 20 are then pivotably collapsed onto respective half members 12, 14 as shown by FIG. 6E, and half members 12 and 14 are the pivotably folded about axis 16 (FIG. 6F).

When the frame members are in the open position, frame support means are provided to keep the frame members 18, 20 in the vertical position. In the preferred embodiment of the invention, the frame support means consists of simply the side walls of the half members (see FIG. 1). In another embodiment, a releasible locking means may be used to lock one or both of frame members 18, 20 in the vertical position. As may be understood from FIGS. 7 and 8, in one preferred embodiment, a slidable detent member 60 is provided which serves to lock the frame members 18 and 20 to the respective half-members 12, 14, as the case may be, in the vertical position, more particularly, as may be seen from FIG. 7. Slidable detent 60 is provided proximate the point 62 of pivotable coupling of the respective arm of each frame member 18 to the respective half member 12. The slidable detent 60 functions to engage an aperture 62 in the respective half member 12 when the respective frame member 18 is fully extended into the vertical upright position shown in FIGS. 1 and 8. This causes the frame member 18 to be locked in the vertical upright position. Release of the slidable detent 60 from aperture 62 as shown in FIG. 8 permits the respective frame member 18 to be collapsed onto the base 8 as shown in FIGS. 2 and 8.

Although the disclosure describes and illustrates preferred embodiments of the invention, it is to be understood that the invention is not limited to these particular embodiments. Many variations and modifications will now occur to those skilled in the art. For definition of the invention, reference is to be made to the appended claims.

The embodiment of the invention in which an exclusive property or privilege is claimed are defined as follows:

1. A collapsible, portable child's play-pen, comprising:

a pair of half members pivotably coupled to each other along an axis, each pivotable about said axis from a first open position wherein each lies in a substantially flat plane to form a base, to a second portable closed position wherein each are folded together in substantially mutually overlying relationship;

a pair of frame members, each pivotably coupled at their respective ends to said base proximate parallel but opposite side edges of said base, whereby said frame members may be pivoted onto said base during collapsible folding of said play-pen;

a first pair of linking arms pivotably coupled to one of said frame members at one end thereof and at another end extending generally perpendicularly outwardly from said frame members when said play-pen is in the open position;

a second pair of linking arms pivotably coupled to another of said frame members at one end thereof and at an opposite end extending generally perpendicularly outwardly from said respective frame member when said play-pen is in the open position;

at least one linking arm of each pair of first and second linking arms possessing releasibly detachable locking engagement means to allow a free end having a releasibly detachable locking engagement of a respective liking arm of said first pair of liking arms with a respective liking arm of said second pair of liking arms so as to form two generally parallel but opposite upper side edges of the child's play-pen when said play-pen is in said open position;

said linking arms and frame members supporting on said upper side edges thereof a flexible sheet in a vertical position around a periphery of said play-pen when said play-pen is in said open position, thereby forming a plurality of vertical walls; and releasible securement means located on said flexible sheet along at least a portion of said upper side edges of said child's play-pen;

whereby at least two linking arms each on mutually opposite upper side edges of said play-pen, when released by said releasible securement means from said flexible sheet, may be pivoted free from said flexible sheet and folded onto a respective frame member to which it is pivotably coupled, and said frame members may, at the same time as said other two linking arms and flexible sheet are being folded onto said frame members, be pivotably folded onto said base, and said half-members then pivoted about said axis to said portable closed position.

2. The collapsible, portable child's play-pen as claimed in claim 1, said half-members each having a width W and a length L, so that when pivotably coupled together and lying in the same plane they form a base of width W and length 2L, said linking arms having a length substantially of length L, said frame members having a height H when said play-pen is in the open position;

wherein length L is always equal to or less than width W and height H is always less than or equal to length L so as to thereby allow said play-pen to be folded into said closed position.

3. The collapsible, portable child's play-pen as claimed in claim 2, wherein said releasible securement means located on said flexible sheet is located along one linking arm of said first pair of linking arms as well as along a mutually parallel but diagonally opposite linking arm of said second pair of linking arms when said play-pen is in said open position, whereby said linking arms, when released by said releasible securement means from said flexible sheet, may be pivoted free from said flexible sheet and folded onto a respective frame member.

4. The collapsible, portable child's play-pen as claimed in claim 2, wherein said releasible securement means located on said flexible sheet is located along each linking arm of said first pair of linking arms, whereby said linking arms, when released by said releasible securement means from said flexible sheet, may each be pivoted free from said flexible sheet and folded onto a respective frame member.

5. The collapsible, portable child's play-pen as claimed in claim 2, wherein said releasible securement means located on said flexible sheet is situate along each arm of said pair of linking arms when said play-pen is in said open position, and each linking arm, when released by said releasible securement means from said flexible sheet, may be pivoted free from said flexible sheet and folded onto a respective frame member.

6. The collapsible, portable child's play-pen as claimed in claim 2, wherein said releasible securement means extends along substantially the entire length of each of said two parallel but opposite upper side edges of the child's playpen when said play-pen is in said open position, and each linking arm, when released by said releasible securement means from said flexible sheet, may be pivoted free from said flexible sheet and folded onto a respective frame member.

7. The collapsible, portable child's play-pen as claimed in claim 2, wherein when said frame members are pivoted onto said half-members, each of said first pair of linking arms is in substantially mutual overlying relationship with the respective other arm of said first pair of linking arms, and each linking arm of said second pair of linking arms is in substantially mutual overlying relationship with the respective other linking arm of said second pair of linking arms.

8. A collapsible, portable, child's play-pen as claimed in claim 1, wherein each arm of each of said pairs of first and second linking arms is each pivoted in said closed position substantially co-planar with a respective frame member to which it is pivotably coupled.

9. A collapsible, portable child's play-pen as claimed in claim 1, wherein said releasible locking engagement means is a hollow sleeve slidable along said linking arms, which may be slid over a point of connection between respective pairs of linking arms so as to releasibly lock such linking arms together to thereby form upper side edges of said play-pen when in the open position.

10. A collapsible, portable child's play-pen as claimed in claim 2, wherein each linking arm of said first pair of linking arms is releasibly detachable from a respective linking arm of said second pair of linking arms.

11. A collapsible, portable child's play-pen as claimed in claim 2, wherein said releasible securement means is a zipper.

12. A collapsible, portable child's play-pen as claimed in claim 2, wherein said releasible securement means is a plurality of releasible snap fasteners.

13. A collapsible, portable child's play-pen as claimed in claim 2, wherein said releasible securement means comprises mating strips of hook and loop fasteners.

14. A collapsible, portable child's play-pen as claimed in claim 2, further possessing frame member support means to support frame members proximate their ends to prevent further pivotable rotation of said frame members past a substantially vertical position when said play-pen is in said open position.

15. A collapsible, portable child's play-pen as claimed in claim 14 wherein said frame members are supported in a vertical position when said play-pen is in said open position by respective proximate side edges of said base.

16. A collapsible, portable child's play-pen as claimed in claim 2, further having frame member support means, wherein said frame member support means comprises releasible lockable detent means to allow at least one of said frame member to be lockingly secured in said vertical position when said play-pen is in said open position, and to allow pivotable collapse of said frame member onto said base when said play-pen is desired to be folded into said closed position.

17. A collapsible portable child's play-pen as claimed in claim 16, wherein said releasible lockable detent means comprises a slidable detent means proximate an end of said at least one frame members which engages an aperture in a respective half-member when said play-pen is in said open position to thereby lock said frame member in a substantially vertical position.

18. A collapsible, portable child's play-pen, comprising:

a pair of substantially rectangular half-members hingeably coupled to each other along an axis, each pivotable about said axis from a first open position wherein each lies in a substantially flat plane to form a base, to a second portable closed position wherein each are folded together in substantially mutual overlying relationship;

a pair of frame members, each pivotably coupled to said base along parallel but mutually opposite edges of said base, whereby said frame members may be pivoted onto said base during collapsible folding of said play-pen;

a first and second pair of linking arms, each linking arm of each first and second pair of linking arms at one end thereof being pivotably coupled to a respective first and second frame member of said pair of frame members, and at another end, being a free end, extending generally perpendicular to said respective frame members, the free end of each pair of linking arms possessing releasibly detachable locking engagement means to allow releasibly detachable locking engagement of said free ends of said first pair of linking arms to said respective free ends of said second pair of linking arms so as to form two generally parallel but opposite upper side edges of the child's play-pen when the play-pen is in said open position;

said linking arms and frame members supporting on said upper side edges thereof a flexible sheet in a vertical position generally around the periphery of said play-pen when said play-pen is in said open position, thereby forming a plurality of vertical walls, said linking arms being enclosed within said flexible sheet;

a pair of zippers located on said flexible sheet along respectively mutually opposite upper side edges of said child's play-pen, whereby at least two linking arms on opposite side edges of said play-pen may, when said zippers are opened, be pivoted free from said flexible sheet and pivotably folded onto the plane of the respective frame members to which they are pivotably coupled, thereafter the remaining linking arms and supported flexible sheet may together be pivotably folded onto a respective frame member which may then at the same time be pivotably folded onto said base, and said half-members then pivoted about said first axis to render said play-pen in said closed position.

19. The collapsible, portable child's play-pen as claimed in claim 18, said half-members each having a width W and a length L, so that when pivotably coupled together they form a base of width W and length 2L, said linking arms having a length substantially of length L, said frame members having a height H when said play-pen is in the open position;

wherein length L is always equal to or less than width W and height H is always less than or equal to length L so as to thereby allow said play-pen to be folded into said closed position.

20. A collapsible, portable child's play-pen as claimed in claim 19, further possessing frame member support means to support frame members proximate their ends to prevent further pivotable rotation of said frame members past a substantially vertical position when said play-pen is in said open position.

* * * * *